United States Patent [19]

Malsbury et al.

[11] Patent Number: 4,679,699

[45] Date of Patent: Jul. 14, 1987

[54] SEALING LID AND CONTAINER

[75] Inventors: Charles R. Malsbury, Palmer; Richard R. Lawrence, Wilbraham, both of Mass.

[73] Assignee: Rexcel, Inc., Ludlow, Mass.

[21] Appl. No.: 865,860

[22] Filed: May 22, 1986

[51] Int. Cl.[4] ..... B65D 39/00

[52] U.S. Cl. ..... 220/307

[58] Field of Search ..... 220/307, 352; 229/43 R

[56] References Cited

U.S. PATENT DOCUMENTS

| | | | |
|---|---|---|---|
| 2,985,354 | 5/1961 | Aldington | 220/307 |
| 3,262,602 | 7/1966 | McConnell et al. | 220/307 |
| 3,677,435 | 7/1972 | Davis | 220/307 |
| 4,006,839 | 2/1977 | Thieh et al. | 220/307 |
| 4,266,689 | 5/1981 | Asher | 220/307 |
| 4,562,937 | 1/1986 | Iyengar | 220/307 |

*Primary Examiner*—George T. Hall

*Attorney, Agent, or Firm*—Pennie & Edmonds

[57] ABSTRACT

A sealing lid and cup container assembly for storing and dispensing comestibles is disclosed wherein the seal is maintained during pressure and vacuum forces. The container includes a cup formed of a frusto-conical sidewall and a bottom wall secured to the sidewall at one end thereof. The sidewall has an outwardly extending and rolled rim at the periphery of its other end defining a circular opening, and a first continuous sealing ridge extending inwardly of the rim. The container also includes a circular lid which is configured and dimensioned for snap-fitting sealing engagement with the cup at its first end such that, when the lid is snapped onto the cup over the opening, the lid includes a flat circular panel having along its periphery an outer wall member which has a second continuous sealing ridge positioned for cooperative sealing engagement with the first continuous sealing ridge of the cup at at least two points of cross-sectional contact so as to provide a first internal sealing of the cup. The lid also has an annular hollow rib which is secured to the outer wall member and is positioned over the rim of the cup. A third continuous sealing ridge on the rib extends outwardly toward and sealingly contacts the rim at at least one point of cross-sectional contact so as to provide a second sealing of the cup.

36 Claims, 4 Drawing Figures

FIG. 3
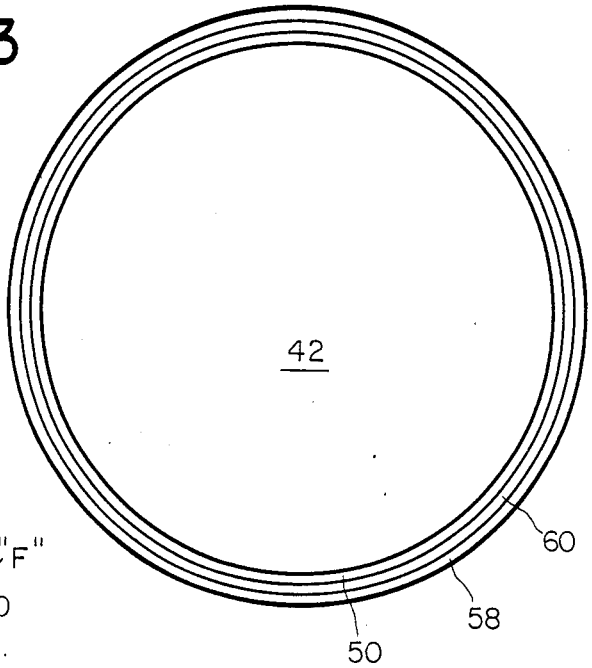
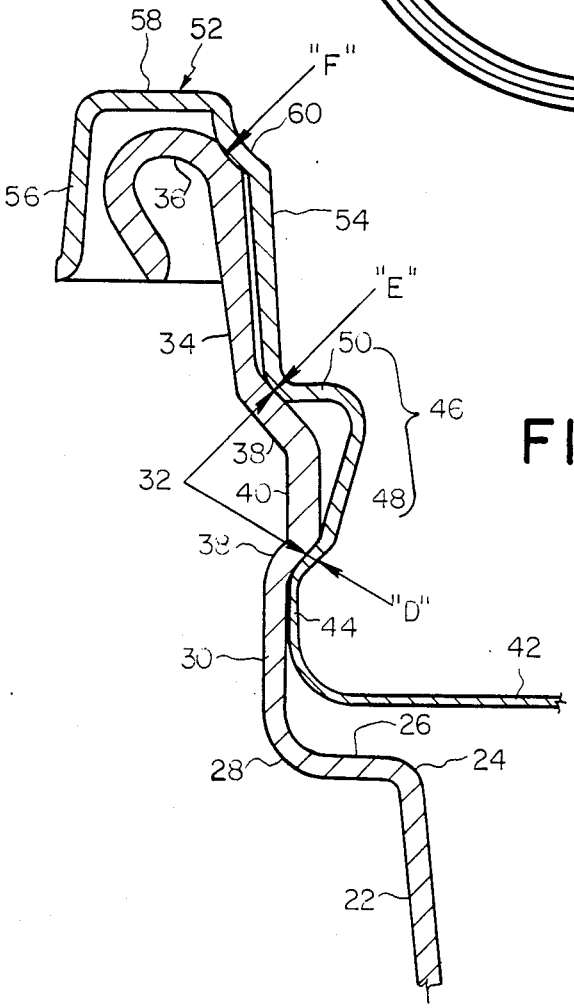
FIG. 4

SEALING LID AND CONTAINER

TECHNICAL FIELD

The present invention relates to a sealing lid for containers. In particular, the present invention relates to a bi-directional sealing lid for a cup assembly for comestibles wherein the sealing lid provides for both a vacuum and pressure seal when positioned on a container.

BACKGROUND ART

Comestibles such as cottage cheese, sour cream, cream cheese dips and the like are typically packaged in cup-like containers having closures or lids made of relatively resilient organopolymetric materials. Closures or lids for such container cups are depressed inwardly relative to the top of the lip and are relatively flexible in construction to provide for ease of handling by the consumer. Such lids, however, present difficulties when forces within the container expand the lip outwardly. In such circumstance they may cause breakage of the seal. Such lids typically provide a two point vacuum seal in cross-section between the lid and the cup. However, such lids loose vacuum as force is applied to pull the lid inwardly since the lowermost sealing point of the lid separates from the cup wall thereby allowing air into the container. Similarly, when lids are constructed to be suitable to maintain a vacuum seal, they are not suitable for maintaining a pressure seal. In the latter case, the forces operate in the opposite direction, i.e., away from the lid.

We have invented a sealing lid which avoids the aforementioned problems and permits bi-directional sealing for both pressure and vacuum forces.

DISCLOSURE OF THE INVENTION

The present invention is directed to a sealing lid for use with a cup formed of an enclosure member having an outwardly extending rim defining an opening and a first sealing means disposed below the opening and extending inwardly of the rim, comprising when the lid is snapped onto the cup over the rim a panel member having a periphery, an outer wall member secured to the panel member along its periphery, and an annular hollow rib secured to the outer wall member and extending over the cup rim. The outer wall member has a second sealing means disposed for cooperative sealing engagement with the first sealing means of the cup so as to provide a first sealing of the cup. The rib has a third sealing means disposed for cooperative sealing engagement with the cup rim so as to provide a second sealing of the cup. The panel member, outer wall member and rib are configured and dimensioned for snap-fitting sealing engagement with the cup over the opening.

In a preferred embodiment, the second sealing means comprises a generally continuous second ridge protruding inwardly away from the rim and sealingly engages with the first sealing means at at least two points of cross-sectional contact. The third sealing means also comprises a generally continuous third ridge protruding outwardly toward the rim and cooperatively sealingly engages with the rim at at least one point of cross-sectional contact. Preferably the panel member and rib are each generally of a circular configuration. Also the panel member, outer wall member and rib are integrally formed.

The present invention also relates to a container comprising a cup formed of a generally cylindrical sidewall member and a bottom wall member secured to the sidewall member at one end thereof. The sidewall member has an outwardly extending rim at the periphery of its other end defining an opening thereat, and a first sealing shoulder means disposed below the rim and extending inwardly of the rim. The container also comprises a sealing lid configured and dimensioned for snap-fitting sealing engagement with the cup at its other end such that, when the lid is snapped onto the cup over the opening, the lid includes a panel member having a periphery, an outer wall member secured to the panel member along its periphery, and an annular hollow rib secured and extending over the cup rim. The outer wall member has a second sealing shoulder means disposed for cooperative sealing engagement with the first sealing shoulder means of the cup so as to provide a first sealing of the cup. The rib has a third sealing shoulder means disposed for cooperative sealing engagement with the cup rim so as to provide a second sealing of the cup.

In this preferred embodiment, the sidewall member is of a frustoconical configuration and the bottom wall member is integrally formed with the sidewall member. The rim also is generally circular and of an outwardly rolled lip configuration. The first and second sealing shoulder means are generally continuous first and second ridges, respectively, protruding inwardly away from the rim. The second ridge cooperatively sealingly engages with the first ridge at at least two points of cross-sectional contact. Also, the third sealing shoulder means comprises a generally continuous third ridge protruding outwardly toward the rim and cooperatively sealingly engages with the rim at at least one point of cross-sectional contact. Preferably the panel member, outer wall member and rib are each generally circular and are integrally formed.

According to this preferred embodiment, the container further comprises wrap means for completely enveloping the cup and lid when the lid is snapped onto the cup over the opening, so as to provide a tamper proof indication of unauthorized entry.

In yet another embodiment, a container for storing and dispensing comestibles comprises a cup formed of a frusto-conical sidewall and a bottom wall secured to the sidewall at one end thereof. The sidewall has an outwardly extending and rolled rim at the periphery of its other end defining a circular opening, and a first continuous sealing ridge extending inwarrddly of the rim. The container also comprises a circular lid configured and dimensioned for snap-fitting sealing engagement with the cup at its first end such that, when the lid is snapped onto the cup over the opening, the lid includes a flat circular panel having a periphery, an outer wall secured to the panel along its periphery, and an annular hollow rib secured to the outer wall and extending over the cup rim. The outer wall has a second continuous sealing ridge disposed for cooperative sealing engagement with the first continuous sealing ridge of the cup so as to provide a first sealing of the cup. The rib has a third continuous sealing ridge disposed for cooperative sealing engagement with the cup rim so as to provide a second sealing of the cup.

Preferably the bottom wall is integrally formed with the sidewall. Also, the rim is generally circular and is of an outwardly rolled lip configuration. The first continuous sealing ridge is positioned uniformly below the rim. Both the outer wall and the rib are each generally circular while the panel, outer wall and the rib are integrally formed. The second continuous sealing ridge protrudes inwardly of the rib and is positioned uniformly below the rib. In this fashion, the first continuous sealing ridge and the second continuous sealing ridge cooperatively sealingly engage at more than two points of cross-sectional contact. In addition, the third continuous sealing ridge protruding outwardly away from the panel cooperatively engages with the rim at at least one point of cross-sectional contact. It is preferred that the cup and lid are each thermoformed of an organopolymetric material and wherein the organopolymetric material is preferably high impact polystyrene. Also the lid can be thermoformed of styrene butidene. The lid is preferably of a nonuniform thickness.

The container according to this preferred embodiment further comprises plastic wrap completely enveloping the cup and lid when the lid is snapped onto the cup over the opening, so as to provide a tamper proof indication of unauthorized entry. The wrap means includes a tear strip and tear tab positioned across the lid.

The present invention is also directed to a method of forming a sealing lid for use with a cup formed of an enclosure member having an outwardly extending rim defining an opening and a first sealing means disposed below the opening and extending inwardly of the rim, comprising forming a panel member having a periphery, forming an outer wall member secured to the panel member along its periphery, the outer wall member having a second sealing means disposed for cooperative sealing engagement with the first sealing means of the cup so as to provide a first sealing of the cup, forming an annular hollow rib on the outer wall member, the rib adapted for extending over the cup rim, the rib having a third sealing means disposed for cooperative sealing engagement with the cup rim so as to provide a second sealing of the cup, and confinguring and dimensioning the panel member, outer wall member and rib for snap-fitting sealing engagement with the cup over the opening.

The present invention also relates to a method of forming a sealed container for storing and dispensing a predetermined content comprising forming a cup of a sidewall member and a bottom wall member secured to the sidewall member at one end thereof, the sidewall member having an outwardly extending rim at the periphery of its other end defining an opening thereat, and a first sealing means disposed below the rim and extending inwardly of the rim, and forming a sealing lid configured and dimensioned for snap-fitting sealing engagement with the cup at its other end such that, when the lid is snapped onto the cup over the opening, the lid includes a panel member having a periphery, an outer wall member secured to the panel member along its periphery, and an annular hollow rib secured to the outer wall member and extending over the cup rim. The outer wall member has a second sealing means disposed for cooperative sealing engagement with the first sealing means of the cup so as to provide a first sealing of the cup. The rib has a third sealing means disposed for cooperative sealing engagement with the cup rim so as to provide a second sealing of the cup. This preferred method further includes filling the cup with the predetermined content and completely enveloping the cup, lid and the predetermined content with wrap means so as to provide a tamper proof indication of unauthorized entry.

BRIEF DESCRIPTION OF THE DRAWINGS

The present invention is described in detail below with reference to the drawings in which:

FIG. 3 is a top view of the sealing lid of the present invention taken along the line 3—3 of FIG. 1.

FIG. 4 is an enlarged partial cross-sectional view of the area encircled by the letter A in FIG. 2.

BEST MODE FOR CARRYING OUT THE INVENTION

In the description which follows, any reference to either direction or orientation is intended primarily and solely for purposes of illustration and is not intended in any way as a limitation of the scope of the present invention. Also, the particular embodiments described herein, although being preferred, are not to be considered as limiting of the present invention. Furthermore, like parts or elements in the various drawings hereto are identified by like numerals for ease of reference.

Figure 1:
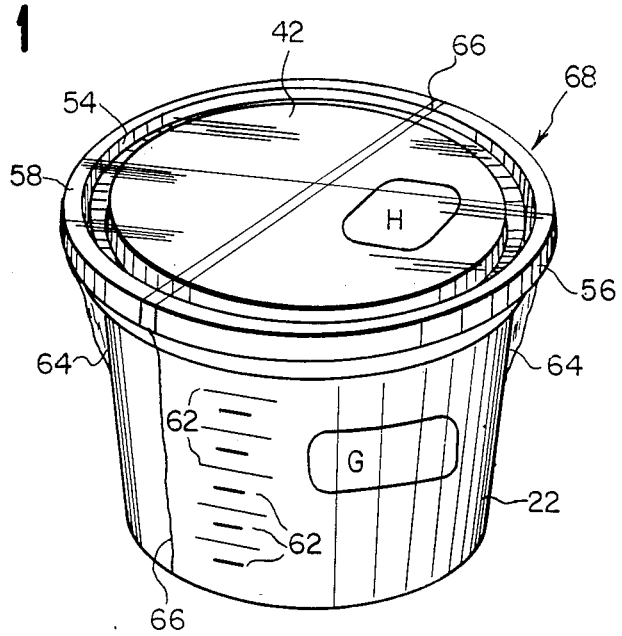
FIG. 1 is a perspective view of a sealing lid according to the present invention when positioned atop a cup to form a container.
Figure 2:
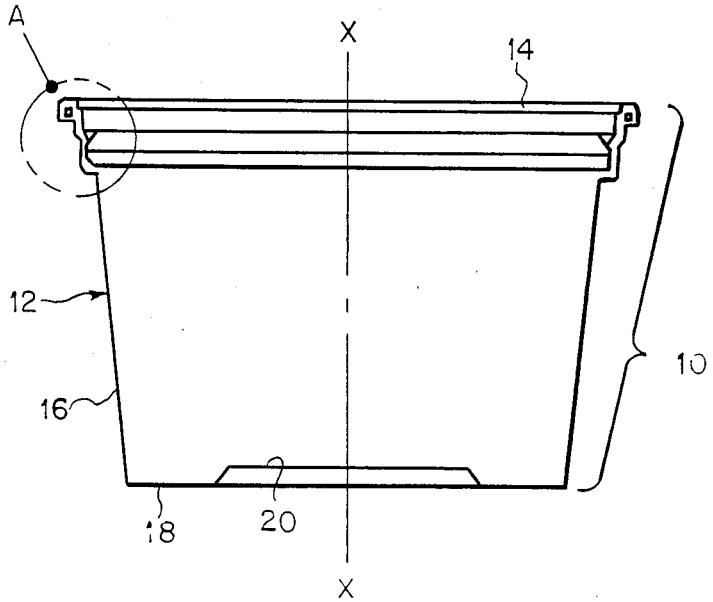
FIG. 2 is an elevational cross-sectional side view taken along the line 2—2 of FIG. 1.

Referring to the drawings, a container 10 for comestibles is shown in FIGS. 1 and 2. The container 10 includes a cup 12 and sealing lid 14 which is positioned over the wide mouth opening of cup 12. The cup 12 is of a conventional or typical cylindrical configuration which provides for internal sealing of the comestible therein. As illustrated in FIGS. 1 and 2, the cup includes a frusto-conically shaped sidewall 16 and an annular bottom wall 18 which merges with a recessed bottom portion 20. At its upper end, the cup 12 provides a wide mouth opening through which the comestible can be passed for packaging and also during removal. As noted above, such wide mouthed container cups 12 are well known for their configurational aspects.

For ease of further discussion herein, it should be noted that the container 10 is symmetrical about its vertical axis denoted by the letters "X—X" in FIG. 2, wherefor, any description of a portion of the container 10 on either side of this axis line provides adequate description of the corresponding mirror image portion on the other side of the vertical axis X—X. For this reason, it is to be understood that any description of the structure of container 10 in cross-section is deemed sufficient for complete description since simply by rotating such cross section about the vertical axis X—X would in fact provide for the entire structure of the container 10.

As shown more clearly in FIG. 4, a preferred embodiment of the sidewall 16 includes a lower frusto-conical wall section 22 which rises to elbow 24 and thereafter extends as radial member 26, elbow 28 and first upper wall member 30 which continues to rise and meets with a shoulder sealing ridge 32 that extends continuously on the inside of the cup 12. Thereafter, the sidewall 16 continues vertically by second upper wall member 34 which terminates in an outwardly rolled lip configuration 36 which constitutes the uppermost portion of sidewall 16 and defines a circular opening into the container cup 12. The shoulder sealing ridge 32 includes inwardly extending leg members 38 which are connected by a middle wall member 40. The shoulder sealing ridge 32 provides for at least two points of sealing on legs 38 as will be described in greater detail hereinbelow.

Sealing lid 14, as shown in FIG. 4, includes a centrally positioned circular flat panel 42 having along its periphery an upwardly extending outer wall 44. The outer wall 44 has a shoulder sealing ridge 46 which is formed of two legs 48 and 50 that extend continuously on the outer wall and cooperate with and sealingly engage legs 38 of the cup shoulder sealing ridge 32 when the lid 14 is positioned on cup 12. The engaging ridges 32, 46 provide a snap-fitting action when the lid 14 is either snapped on or off from cup 12 for sealing or opening purposes, respectively. As illustrated in FIG. 4, the leg portions 48 and 50 of lid ridge 46 engage and contact the leg portions 38 of cup ridge 32 preferably at at least two contact points in cross-section as denoted by the capital letters "D" and "E" in FIG. 4. These contact points D provide for two sealing points internally of the cup 12. In this manner, the lid 14 is secured and impermeably seals the contents of cup 12. The lid 14 and cup 12 are constructed of materials which provide the necessary resiliency required to maintain the sealing points D in frictional engagement with each other.

The sealing lid 14 also includes an upwardly extending hollow rib 52 which is joined to the outer wall 44 as illustrated in FIG. 4. The hollow rib 52 is formed of downwardly extending inner wall portion 54 and outer wall portion 56 that are joined at their upper edges by a wall portion 58 that is aligned in orientation with and positioned above the plane of panel 42. The hollow rib 52 includes a shoulder sealing ridge 60 as shown in FIG. 4. The sealing ridge 60 extends continuosly outwardly so as to sealingly engage the rim 36 of the cup 12 at at least one contact point in cros-sectionn as denoted by capital letter "F" in FIG. 4.

The lid 14 of the present invention thus provides the sealing necessary to accomodate both pressure and vacuum forces as well as to permit nestable stacking of a plurality of like lids 14 upon one another for ease of handling in automated packing apparatus as well as to economize on the utilization of storage space.

In accordance with the invention, organopolymetric materials are utilized in the manufacture of the lids 14 and cups 12. In this regard, suitable organopolymetric materials permit thermoforming of the lids 14 and cups 12. Organopolymetric materials have been found to be particularly suitable materials for manufacture of lids 14 and cups 12 in accordance with the present invention, and are particularly preferred herein. In one preferred embodiment the cup 12 and lid 14 are each integrally thermoformed of high impact polystyrene. Alternatively, the lid 14 in another preferred embodiment can be thermoformed of styrene butidene. As noted, the organopolymetric lids 14 which are relatively or generally rigid are circular or disc shaped and are suitably wide for snapping frictional engagement with a relatively large circular mouthed frustoconical cup 12. Preferably the lid 14 includes a circular panel 42 having a diameter slightly larger than that of the bottom 18 of the cup 12 it will support as shown in FIGS. 1 and 2. The panel 42 which is substantially planar is below the wall portion 58 of hollow rib 52 and also the uppermost portion of rim 36 on the cup 12 when the lid 14 is snappingly secured atop the cup 12. This permits the next upper stacked container 10 to remain in supporting beads or molded surface designs for structural or aesthetic purposes.

Although the cup 12 and lid 14 are typically formed of an opaque material, the lid 14 can alternatively be made transparent to permit viewing of the contents through the clear plastic wrap 16. If desired, the cup 12 can also be made transparent for viewing purposes as well. In addition, the cup 12 and lid 14 can be imprinted on their outer surfaces to provide useful information to the consumer as indicated by the letters "G" and "H" in FIG. 1. Such information includes identification of contents, manufacturer and the like. Also, gradations 62 can be provided on the outside of the cup 12 as shown in FIG. 1. Such gradations 62 are particularly useful when the cup 12 is transparent so as to indicate the volume of the contents.

After the cup 12 is filled, for example, with a comestible such as cottage cheese, and the lid 14 snap-fitted thereon so as to seal the comestible, the lid 14 and cup 12 can be completely enveloped and sealed, if desired, in a clear or transparent film of plastic wrap 64 which thereafter can be unsealed and removed. The plastic wrap 64 is of the shrink-film type formed of plastic such as CLYSAR shrink film. To expose the contents, the lid 14 is removed from the cup 12 and the comestible contained therein removed for use by the customer or consumer. The plastic wrap 64 provides for clear evidence of any unauthorized entry into the container 10 and thereby avoids any contamination or adulteration of the contents of the container 10 by any person other than the purchaser or customer. In addition, the plastic wrap 64 is impermeable to fluids which increases the shelf life of the comestibles inside container 10 by reducing moisture loss. Moreover, the plastic wrap 16 helps to avoid accidental opening of the lid 14 which provides less chance of spilling during packaging and transportation. Preferably the plastic wrap 64 also has a tear line 66 across the upper face of the lid 14 and which ends in a tab 68. The latter provides ease in pulling away from the container 10 and breaking the tear line 66 across the face of the plastic wrap 64 on the top of the container 10.

After a number of cups 12 and lids 14 have been packaged in this manner, they can stacked one atop the other in desired arrangements for storage and/or shipping. The panel 42 of the lid 14 is the same size or slightly larger than the annular bottom 18 of the cup 12 so as to support the annular bottom 18 of an upper stacked cup 12.

The lid 14 according to the present invention is able by its construction to provide both a pressure and a vacuum seal. In particular, it is able to achieve an internal pressure seal and hold at least about .75 pounds per square inch for at least about one second. Pressure seals in excess of the aformentioned pressure sealing parameters have been achieved with the sealing lid of the present invention. The internal pressure seal is obtained when internal pressure bows the center of the lid 14 upwardly so as to increase the force at seal D as shown in FIG. 4.

Also, the lid 14 can provide at least a vacuum seal of about 1 inch of vacuum for at least about one second. Again as was the case with the pressure seal, vacuum seals in excess of the aforementioned vacuum sealing parameters have achieved with the sealing lid of the present invention. The vacuum seal is provided by the downward force of lid 14 when vacuum is applied thereby pulling seal F tighter against the rim 36 of cup 12. If the cup 12 is vented, then vacuum sealing is obtained by seal F being above the point of venting.

While the present invention has been described and illustrated herein with respect to a preferred embodiment thereof, it should be apparent that various modifications, adaptations and variations may be made utilizing the teachings of the present disclosure without departing from the scope of the invention, and are intended to be within the scope of the present invention.

We claim:

1. A sealing lid for use with a cup, formed of an enclosure member having an outwardly extending rim defining an opening and a first sealing means disposed below said opening and extending inwardly of said rim, comprising when said lid is snapped onto the cup over the rim:

a. a panel member having a periphery;

b. an outer wall member secured to said panel member along its periphery, said outer wall member having a second sealing means disposed for cooperative sealing engagement with said first sealing means of said cup so as to provide a first sealing of said cup;

c. an annular hollow rib secured to said outer wall member and extending over said cup rim, said rib having a third sealing means disposed for cooperative sealing engagement with said cup rim so as to provide a second sealing of said cup; and d. said panel member, outer wall member and rib being configured and dimensioned for snap-fitting sealing engagement with said cup over said opening.

2. The lid according to claim 1 wherein said second sealing means comprises a generally continuous second ridge protruding inwardly away from said rim.

3. The lid according to claim 2 wherein said generally continuous second ridge cooperatively sealingly engages with said first sealing means at at least two points of cross-sectional contact.

4. The lid according to claim 1 wherein said third sealing means comprises a generally continuous third ridge protruding outwardly toward said rim.

5. The lid according to claim 4 wherein said generally continuous third ridge cooperatively sealingly engages with said rim at at least one point of cross-sectional contact.

6. The lid according to claim 1 wherein said panel member and rib are each generally of a circular configuration.

7. The lid according to claim 1 wherein said panel member, outer wall member and rib are integrally formed.

8. A container comprising:

a. a cup formed of a generally cylindrical sidewall member and a bottom wall member secured to said sidewall member at one end thereof, said sidewall member having an outwardly extending rim at the periphery of its other end defining an opening thereat, and a first sealing shoulder means disposed below said rim and extending inwardly of said rim; and b. a sealing lid configured and dimensioned for snap-fitting sealing engagement with said cup at its other end such that, when said lid is snapped onto the cup over said opening, said lid includes:

(1) a panel member having a periphery;

(2) an outer wall member secured to said panel member along its periphery, said outer wall member having a second sealing shoulder means disposed for cooperative sealing engagement with said first sealing shoulder means of said cup so as to provide a first sealing of said cup; and (3) an annular hollow rib secured to said outer wall member and extending over said cup rim, said rib having a third sealing shoulder means disposed for cooperative sealing engagement with said cup rim so as to provide a second sealing of said cup.

9. The container according to claim 8 wherein said sidewall member is of a frustoconical configuration.

10. The container according to claim 9 wherein said bottom wall member is integrally formed with said sidewall member.

11. The container according to claim 10 wherein said rim is generally circular.

12. The container according to claim 11 wherein said rim is of an outwardly rolled lip configuration.

13. The container according to claim 8 wherein said first sealing shoulder means comprises a generally continuous first ridge protruding inwardly away from said rim.

14. The container according to claim 13 wherein said second sealing shoulder means comprises a generally continuous second ridge protruding inwardly away from said rim.

15. The container according to claim 14 wherein said second ridge cooperatively sealingly engages with said first ridge at at least two points of cross-sectional contact.

16. The container according to claim 15 wherein said third sealing shoulder means comprises a generally continuous third ridge protruding outwardly toward said rim.

17. The container according to claim 16 wherein said third ridge cooperatively sealingly engages with said rim at at least one point of cross-sectional contact.

18. The container according to claim 17 wherein said panel member, outer wall member and rib are each generally circular.

19. The container according to claim 18 wherein said panel member, outer wall member and rib are integrally formed.

20. The container according to claim 19 further comprising wrap means for completely enveloping said cup and lid when said lid is snapped onto the cup over said opening, so as to provide a tamper proof indication of unauthorized entry.

21. A container for storing and dispensing comestibles comprising:

a. a cup formed of a frusto-conical sidewall and a bottom wall secured to said sidewall at one end thereof, said sidewall having an outwardly extending and rolled rim at the periphery of its other end defining a circular opening, and a first continuous sealing ridge extending inwardly of said rim;

b. a circular lid configured and dimensioned for snap-fitting sealing engagement with said cup at its first end such that, when said lid is snapped onto the cup over said opening, said lid includes:

(1) a flat circular panel having a periphery;

(2) an outer wall secured to said panel along its periphery, said outer wall having a second continuous sealing ridge disposed for cooperative sealing engagement with said first continuous sealing ridge of said cup so as to provide a first sealing of said cup; and (3) an annular hollow rib secured to said outer wall and extending over said cup rim, said rib having a third continuous sealing ridge disposed for cooperative sealing engagement with said cup rim so as to provide a second sealing of said cup.

22. The container according to claim 21 wherein said bottom wall is integrally formed with said sidewall.

23. The container according to claim 22 wherein said rim is generally circular.

24. The container according to claim 23 wherein said rim is of an outwardly rolled lip configuration.

25. The container according to claim 24 wherein said first continuous sealing ridge is positioned uniformly below said rim.

26. The container according to claim 21 wherein said outer wall and said rib are each generally circular.

27. The container according to claim 26 wherein said panel, outer wall and said rib are integrally formed.

28. The container according to claim 27 wherein said second continuous sealing ridge protrudes inwardly of said rib and is positioned uniformly below said rib.

29. The container according to claim 28 wherein said first continuous sealing ridge and said second continuous sealing ridge cooperatively sealingly engage at more than two points of cross-sectional contact.

30. The container according to claim 29 wherein said third continuous sealing ridge protrudes outwardly away from said panel.

31. The container according to claim 30 wherein said third continuous sealing ridge cooperatively engages with said rim at at least one point of cross-sectional contact.

32. The container according to claim 31 wherein said cup and lid are each thermoformed of an organopolymetric material.

33. The container according to claim 32 wherein said organopolymetric material is preferably high impact polystyrene.

34. The container according to claim 33 wherein said cup is thermoformed of high impact polystyrene and said lid is thermoformed of styrene butidene.

35. The container according to claim 34 wherein said lid is of a nonuniform thickness.

36. The container according to claim 22 further comprising plastic wrap completely enveloping said cup and lid when said lid is snapped onto the cup over said opening, so as to provide a tamper proof indication of unauthorized entry, said wrap means including a tear strip and tear tab positioned across said lid.

* * * * *